United States Patent [19]

Legros

[11] 4,018,203

[45] Apr. 19, 1977

[54] DECOMPRESSING DEVICE

[75] Inventor: Andre Legros, Marly le Roi, France

[73] Assignee: Bernard-Moteurs, Paris, France

[22] Filed: Jan. 9, 1976

[21] Appl. No.: 647,674

[30] Foreign Application Priority Data

Jan. 17, 1975 France ..... 75.01559

[52] U.S. Cl. ..... 123/182; 123/196 S

[51] Int. Cl.[2] ..... F01L 13/08

[58] Field of Search ..... 123/182, 196 S

[56] References Cited

UNITED STATES PATENTS

| | | | |
|---|---|---|---|
| 868,765 | 10/1907 | Dock | 123/182 |
| 2,323,304 | 7/1943 | Bowman | 123/182 |
| 3,395,689 | 8/1968 | Kruse | 123/182 |
| 3,511,219 | 5/1970 | Esty | 123/182 |

FOREIGN PATENTS OR APPLICATIONS

| | | | |
|---|---|---|---|
| 865,039 | 5/1941 | France | 123/182 |

*Primary Examiner*—C. J. Husar
*Assistant Examiner*—David D. Reynolds
*Attorney, Agent, or Firm*—Beveridge, DeGrandi, Kline & Lunsford

[57] ABSTRACT

A decompressing device for facilitating starting of internal combustion engines, by lifting one of the engine valves at the beginning of the compression cycle, comprises a lever which is movable, by hydraulic pressure developed by an engine-driven oil pump, from an extended position in which one end of the lever effects said valve lifting to a retracted position. Lifting of the valve therefore stops when the engine speed (and hence the hydraulic pressure) reaches a predetermined level. The lever is moved between the extended and retracted positions by piston means located in a bore in the engine camshaft, the piston means being acted upon in one direction by the hydraulic pressure, and in the opposite direction by resilient means which tends to move the lever to the extended position.

9 Claims, 4 Drawing Figures

DECOMPRESSING DEVICE

Figure 1:
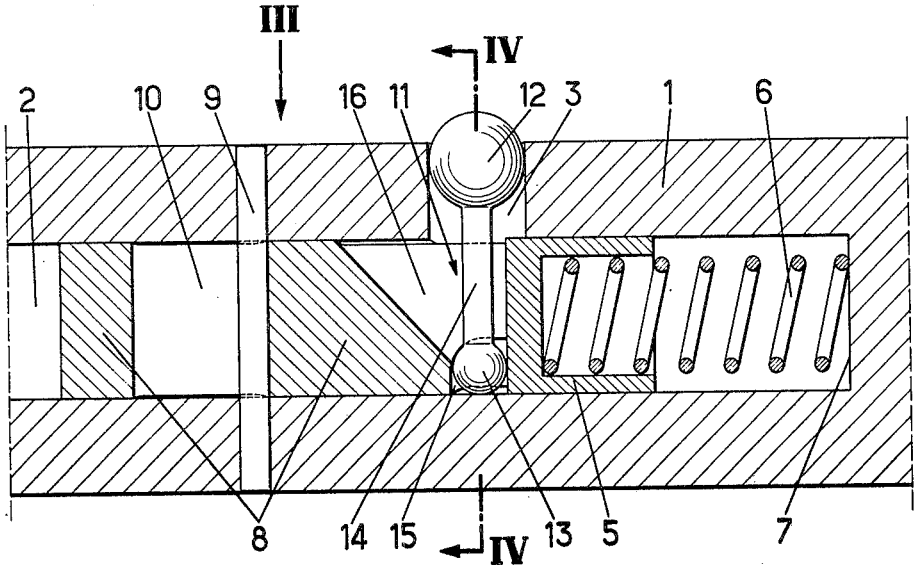

This invention relates to a decompressing device for internal combustion engines which makes starting easier by lifting one of the valves at the commencement of the compression cycle.

The principle of decompressing internal combustion engines in this way is known. In a device which is the subject of our French Pat. No. 72.46026, when the engine is started, a protrusion is introduced on the circular part of the exhaust cam of the camshaft. This protrusion opens the exhaust valve slightly at the commencement of the compression cycle thus allowing some air/fuel mixture to escape. The compression pressure is thereby lowered the less energy is required to push the piston past top dead centre. Manual starting of the engine, or starting with the starter motor, therefore becomes easier. As soon as the engine reaches a certain rotational speed, which is less than idling speed, the protrusion is retracted.

This known device, used widely in single cylinder engines of the type used in mobile pump units, small charging plants and mowing machines, makes use of centrifugal force to retract the protrusion. It comprises a mechanism attached to one end of the camshaft and projecting radially outwards a considerable distance from the camshaft.

An object of the present invention is to provide a decompressing device which is of simple construction and is compact and more reliable than the prior art device.

According to the invention, a decompressing device comprises piston means free to move in an axial direction in a bore in an engine camshaft and urged in an axial direction by hydraulic pressure from an engine-driven oil pump against the action of resilient means, the device further comprising a lever having a first end in the form of a retractable protrusion able to move radially in an aperture in the camshaft so that in an extended position the protrusion causes opening of an engine valve and in a retracted position does not cause opening of the valve, the other end of the lever being movable by said piston means sliding in the camshaft so that the first end moves from the extended position to the retracted position as the hydraulic pressure increases.

This decompressing device is very compact and straight-forward because the moving parts, which comprise in all the piston means, the lever and the resilient means, are fitted inside the hollow camshaft, the only modification required to the latter for adaptation of the decompressing device being an aperture machined in line with one of the cams.

The oil pressure is zero when the engine is started from the rest, and the resilient means causes the end of the lever acting as the retractable protrusion to emerge from the camshaft and provide the desired decompression. As soon as the oil pressure is sufficiently high to compress the spring after a few engine revolutions, the protrusion is retracted, allowing the engine to run with a normal compression cycle.

The device according to the invention provides, in addition, a lubrication safeguard because, when the oil pressure is insufficient, for example when the oil pump fails or an oil leak exists, the retractable protrusion will emerge from the camshaft and the engine will not be able to pick up speed.

Figure 2:
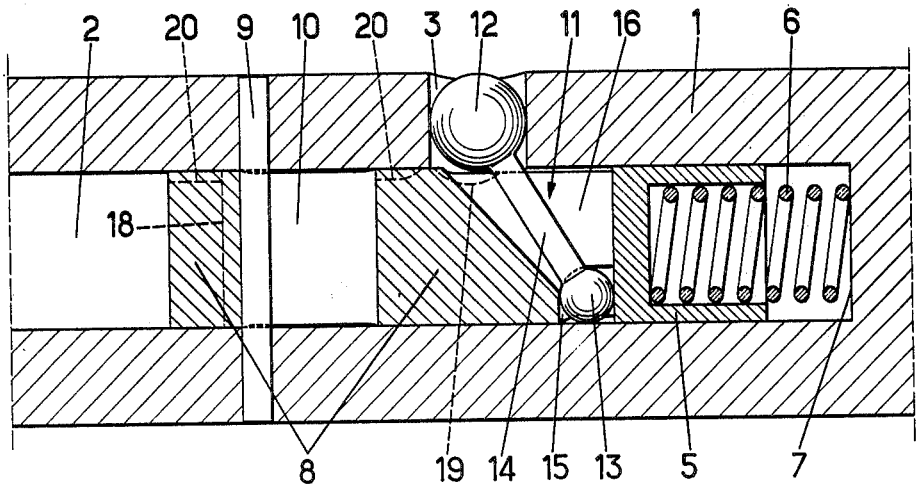
Figure 3:
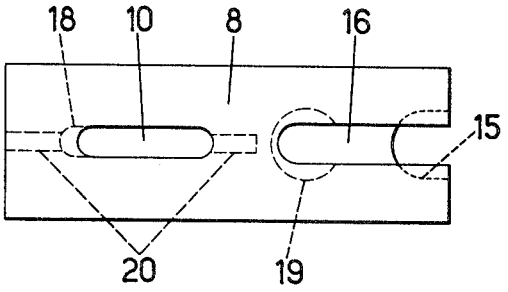
Figure 4:
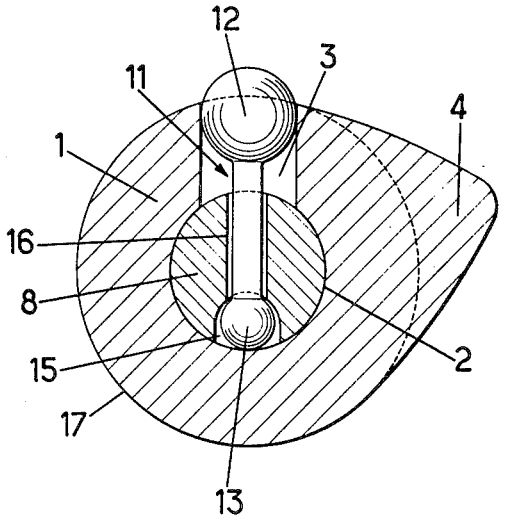

An embodiment of the invention will now be described, by way of example, with reference to the accompanying drawings, in which:

FIG. 1 is a longitudinal cross section of a part of a camshaft fitted with a device according to the invention, with a retractable protrusion extended outwards, FIG. 2 is a longitudinal cross section similar to FIG. 1 but with the protrusion retracted, FIG. 3 is a view of a piston of the device looking in the direction of arrow 111 in FIG. 1, and FIG. 4 is a cross section taken along a line IV—IV in FIG. 1.

The decompressing device according to the invention as illustrated in FIGS. 1 and 2, is fitted inside a camshaft 1 which has a longitudinal blind bore 2. The camshaft 1 also has a radial aperture 3 in line with one of the cams 4 (seen in FIG. 4), for example the exhaust cam. A rotating seal, not shown, is provided at the end of the camshaft 1, on the left in FIGS. 1 and 2. This seal transmits hydraulic pressure to the bore 2 from a lubricating oil pump (not shown), which is driven by the engine.

A piston 5, which is urged towards the left in FIGS. 1 and 2 by a calibrated spring 6 abutting against the end 7 of the bore 2 in the camshaft 1, is a sliding fit axially in the bore 2. A second piston 8, made for example from plastics or sintered material, is fitted to slide axially, with clearance, ahead of the piston 5 in the bore 2 in the camshaft 1. The travel of the piston 8 towards the left in FIGS. 1 and 2 under the influence of the spring 6 is restricted by a pin 9 passing through the camshaft 1 and a slot 10 in the piston 8. At the same time the pin 9 prevents the piston 8 from turning relative to the camshaft 1.

A lever 11 is fitted to move in the bore 2 between the pistons 5 and 8. The lever 11 in the example illustrated has the shape of a dumb-bell having two spherical ends 12 and 13 interconnected by a cylindrical section 14. The spherical end 12 of the lever 11, with a diameter more or less equal to the wall thickness of the hollow camshaft 1, is fitted in the aperture 3 in the camshaft 1 in the manner of a ball joint, the aperture taking the form of a radially drilled cylindrical hole with a diameter corresponding substantially to the diameter of the spherical end 12. The other spherical end 13 of the lever 11, which has a diameter less than that of the end 12, is fitted in a recess 15 in the piston 8 machined radially from the skirt towards the inside, and axially towards the inside from the end face of the piston 8 adjacent the piston 5. The size of the recess 15 substantially corresponds, both radially and longitudinally, with the diameter of the spherical end 13 on the lever 11. This recess 15, which is shaped at the bottom to match the spherical end 13 on the lever 11 thus opens radially and axially and is bounded on the one hand by the bore 2 in the camshaft 1 and on the other hand by the piston 5, the piston 5 being held in contact with the piston 8 by the action of the spring 6, thus holding the end 13 of the lever 11 captive in the recess 15.

The piston 8 is prevented from turning and is held by the pin 9 in such an angular position relative to the camshaft 1 that the recess 15 provided in the piston 8 and the aperture 3 in the camshaft 1 are always in the same plane passing through the longitudinal centre line of the camshaft 1.

The spherical section 14 on the lever 11 passes through a slot 16 machined obliquely upwards and to the left in the piston 8, as seen in FIGS. 1 and 2, from the end of the piston 8 facing the piston 5 at the recess 15, to allow the piston 8 to move axially towards the end 7 of the bore 2 even though the end 12 of the lever 11, held in the aperture 3, takes no part in this axial movement.

The device described above operates as follows. When the engine is switched off, the spring 6 pushes the pistons 5 and 8 into the position illustrated in FIG. 1 because, due to the absence of lubricating oil pressure, the piston 8 is not pushed towards the right. This movement to the left is limited by the pin 9 which stops the piston 8 in a position in which the recess 15 is in the same transverse plane as the aperture 3. In consequence, the lever 11 takes up a position at right angles to the axis of the camshaft 1, a position in which the end 13 of the lever 11 rests radially against the wall of the bore 2, whereas the other end 12 protrudes partially from the aperture 3 and is proud of the circular part of the exhaust cam 3 (refer to FIGS. 1 and 4).

Hence, when the engine is started the protrusion formed by the end 12 of the lever 11 lifts the exhaust valve at the commencement of the compression cycle during the first few revolutions, thus creating the partial decompression desired.

Irrespective of the load applied to the end 12 of the lever 11 in the above position, the lever is locked in position because the load applied to it is at right angles to the wall bore 2 which acts as a thrust face for the end 13. For this reason the strength of the spring 6 need only be sufficient for the lever 11 to be held in this position by the piston 5 which presses against the piston 8, which in turn bears against the pin 9.

As soon as the engine fires, the engine-driven oil pump delivers oil under pressure along the bore 2 in the camshaft 1, which pressure forces the piston 8 and, at the same time, the piston 5 towards the right (as viewed in FIG. 1) against the action of the spring 6. The end 13 of the lever 11 held in the recess 15 is obliqued to follow this movement. Bearing in mind that the end 12 of the lever 11 can move only in the manner of a ball joint and in a vertical direction in the aperture 3, the lever 11 then takes up an inclined position as illustrated in FIG. 2, its cylindrical section 14 entering further into the slot 16 so that the end 12 is drawn radially into the slot 3 and no longer protrudes from the circular part 17 of the exhaust cam 4.

Due to the described shape of the recess 15 machined in the piston 8 and due to the permanent compression of the spring 6, there is no risk of the end 13 of the lever 11 being forced out of the recess 15 under the influence of gravity or centrifugal force.

Any oil which leaks past the piston 8 while the engine is running, as a result of play of the piston 8 in the bore 2 in the camshaft 1, is expelled via the bore 3 due to the centrifugal force and serves to lubricate the valve tappet (not illustrated).

It should be noted that the device as described above may be adapted to become an oil pressure release valve with one or two modifications. To do this, the travel of the piston 8 towards the right as seen in FIG. 2 must be increased, and a longitudinal oil pressure release groove which does not extend to the end of the piston 8 in the direction of the spring 6 must be machined in the piston. This is illustrated, by way of example, by dotted lines in FIGS. 2 and 3, in which the slot 10 is extended by a portion 18 to the left and in which the piston 8 includes a depression 19 to allow the end 12 of the lever 11 to enter the piston 8 just radially, this being necessary for the extra travel of the piston 8 towards the right not to be impeded by the lever 11. In the example illustrated, a longitudinal groove 20 is machined in the piston 8 in line with the slots 10 and 16 to within a short distance of the depression 19. Hence, as long as the lubricating oil pressure does not exceed a set value defined by the strength of the calibrated spring 6, the lever 11 is held in the position illustrated in FIG. 2 by the opposing actions of oil pressure and spring 6, and the relief valve, comprising the slot 20 working in conjunction with the aperture 3, is closed. On the other hand, if the oil pressure increases excessively, for example following blockage in part of the lubrication circuit not associated with the decompressing device, the thrust exerted by the oil pressure on the piston 8 exceeds the thrust of the spring 6 and the piston 8 travels further towards the spring 6 until the part 18 contacts the pin 9, the end 12 of the lever 11 thus entering the depression 19. The oil pressure release valve slot 20 is then uncovered by the aperture 3, and oil is allowed to pass which may be expelled by the aperture 3.

It should be noted that the embodiment described above and illustrated in the attached drawing has been given as a purely illustrated example only, and it is possible to add various modifications and variations in construction without, however, going beyond the scope of the invention. Thus, for example, the spherical end 12 of the lever 11 forming the retractable protrusion may have a diameter greater than the thickness of the hollow wall of the camshaft 1, in which case appropriate measures must be taken with the piston 8 or on the end 12 of the lever 11 to enable the retractable protrusion to enter the aperture 3 until it no longer extends beyond the circular part 17 on the cam 4. Furthermore, the oil pressure release slot 20 may also be machined in a plane other than that for the slots 10 and 16 in the piston 8, and may thus work in conjunction with an orifice other than the radial aperture 3 provided for the end 12 of the lever 11.

We claim:

1. A decompression device for facilitating starting of an internal combustion engine, comprising piston means movable in an axial direction in a bore in an engine camshaft and urged in an axial direction by hydraulic pressure from an engine-driven oil pump against the action of resilient means; and a lever having a first end forming a retractable protrusion able to move radially of the camshaft in an aperture in the camshaft so that in an extended position the protrusion causes opening of an engine valve and in a retracted position does not cause opening of the valve, the other end of the lever being movable by said piston means sliding in the camshaft so that the first end moves from the extended position towards the retracted position as the hydraulic pressure increases.

2. A device according to claim 1, in which the piston means comprises first and second pistons located end-to-end in the camshaft bore, the first piston being acted upon by the hydraulic pressure, and the second piston being acted upon by the resilient means.

3. A device according to claim 2, in which said other end of the lever is housed in a recess in the first piston.

4. A device according to claim 3, in which the end of the lever housed in the recess is held therein by the adjacent end of the second piston.

5. A device according to claim 4, in which the recess is bordered in the radial direction by the surface of the bore in the camshaft.

6. A device according to claim 2, including a pin extending through the camshaft and through a slot in the first piston to limit the travel of the first piston and to prevent the first piston from rotating relative to the camshaft.

7. A device according to claim 6, in which the slot in the first piston is so positioned that the lever is at right angles to the camshaft axis when the protrusion is in the extended position.

8. A device according to claim 1, including an oil pressure release slot in the piston means, which slot communicates with an oil outlet in the event of excessive travel of the piston means as a result of excess oil pressure.

9. A device according to claim 8, in which said aperture in the camshaft acts as the oil outlet.

* * * * *